US011071368B2

(12) United States Patent
Wenck

(10) Patent No.: US 11,071,368 B2
(45) Date of Patent: Jul. 27, 2021

(54) APPLICATOR SYSTEM

(71) Applicant: Rowena Wenck, Peakhurst (AU)

(72) Inventor: Rowena Wenck, Peakhurst (AU)

( * ) Notice: Subject to any disclaimer, the term of this patent is extended or adjusted under 35 U.S.C. 154(b) by 0 days.

(21) Appl. No.: 16/487,191

(22) PCT Filed: Feb. 27, 2018

(86) PCT No.: PCT/AU2018/050166
§ 371 (c)(1),
(2) Date: Aug. 20, 2019

(87) PCT Pub. No.: WO2018/157200
PCT Pub. Date: Sep. 7, 2018

(65) Prior Publication Data

US 2020/0205551 A1 Jul. 2, 2020

(30) Foreign Application Priority Data

Mar. 3, 2017 (AU) ..... 2017900742

(51) Int. Cl.
*A45D 40/22* (2006.01)
*A45D 40/26* (2006.01)
(Continued)

(52) U.S. Cl.
CPC ..... *A45D 40/222* (2013.01); *A45D 40/264* (2013.01); *A46B 17/02* (2013.01);
(Continued)

(58) Field of Classification Search
CPC ..... A45D 2040/0012; A45D 2040/227; A45D 40/0075; A45D 40/22; A45D 40/222;
(Continued)

(56) References Cited

U.S. PATENT DOCUMENTS 632,806 A * 9/1899 Cragin ..... B65D 1/04 215/6
1,211,461 A 1/1917 Long
(Continued)

FOREIGN PATENT DOCUMENTS

CN 104414087 A 3/2015
DE 202010001225 U1 4/2010
(Continued)

OTHER PUBLICATIONS

Woodturner's Resource; Toroid Box; published on Jun. 5, 2005; http://www.woodturnersresource.com/wrphotopost/showphoto.php?photo=700&title=toroid-box&cat=500.

*Primary Examiner* — David P Angwin
*Assistant Examiner* — Bradley S Oliver
(74) *Attorney, Agent, or Firm* — Young Basile Hanlon & MacFarlane, P.C.

(57) ABSTRACT

An applicator system comprises a container and an applicator. The container is configured to contain a substance to be applied using the applicator. The container is further configured to support the applicator in an accessible orientation in use. For example, the container can comprise a first chamber that is open at an end thereof. The first chamber can be arranged to receive and locate at least an active end of the applicator therein and to hold the applicator in the accessible orientation in use. The container can also comprise a second chamber that is arranged to receive and hold therein the substance to be contacted by the active end of the applicator in use.

22 Claims, 9 Drawing Sheets

(51) Int. Cl.
*A45D 40/00* (2006.01)
*A46B 17/02* (2006.01)

(52) U.S. Cl.
CPC ..... *A45D 2040/0012* (2013.01); *A45D 2200/1018* (2013.01); *A45D 2200/25* (2013.01); *A46B 2200/1046* (2013.01)

(58) Field of Classification Search
CPC .... A45D 40/223; B65D 1/07; B65D 47/0871; B65D 2251/1058; B65D 1/04
USPC ..... 401/125
See application file for complete search history.

(56) References Cited

U.S. PATENT DOCUMENTS

| | | | | |
|---|---|---|---|---|
| 1,942,248 | A | 1/1934 | Kemp | |
| 3,983,993 | A | 10/1976 | Hsu | |
| 4,513,877 | A * | 4/1985 | Taguchi | A45C 13/1084 16/256 |
| 6,427,864 | B1 | 8/2002 | Asselin | |
| 2004/0084452 | A1 | 5/2004 | Hsieh | |
| 2006/0016212 | A1 | 1/2006 | Roth et al. | |
| 2010/0206881 | A1 | 8/2010 | O'Connor et al. | |
| 2011/0155629 | A1 | 6/2011 | Debauge et al. | |
| 2014/0352329 | A1 | 12/2014 | Bloedow et al. | |
| 2015/0320246 | A1 | 11/2015 | Jorge | |

FOREIGN PATENT DOCUMENTS

| | | | |
|---|---|---|---|
| GB | 2138781 | B | 8/1986 |
| WO | 0005144 | A1 | 2/2000 |

* cited by examiner 30
16
20
60
10
48
66
60
20
33
56
54
55
30
31
22
15
16

54
55
52
30
56
60
64
48
44
42
40
28
50
26
31
29
62
66

DETAIL A
DETAIL B
DETAIL C
36
60
30
44
A
29
32
15
16
18
20
22
24
26
28
B
64
C
39
37
38
42
40
50
66
46
48

APPLICATOR SYSTEM

CROSS REFERENCE TO RELATED APPLICATION

The present application claims priority to Australian Patent Application No. 2017900742, filed Mar. 3, 2017, incorporated herein in its entirety.

TECHNICAL FIELD

An applicator system is disclosed that comprises a container and an applicator. The container is configured to contain a substance to be applied using the applicator. The container is also configured to support the applicator in an accessible orientation in use.

BACKGROUND

Cosmetic, therapeutic and medicament creams, ointments and lotions can be held in tub-like containers. When the cream, ointment or lotion is accessed (e.g. scooped) by hand, it can become contaminated. For example, contamination may occur when a cream is being repeatedly applied to a baby during a nappy change. Also, with tub-containers, a user's hands become coated with the cream, ointment or lotion that is accessed. This may not always be desirable, for example, when the cream is water-repellent and so is not easily washed off.

One known solution to the contamination and handling issue is to use a spatula to apply the cream, ointment or lotion to a user's skin. After use, an end of the spatula can then be wiped clean with a disposable napkin/wipe.

The above references to the background art do not constitute an admission that the art forms a part of the common general knowledge of a person of ordinary skill in the art. The above references are also not intended to limit the application of the container and applicator as disclosed herein.

SUMMARY

Disclosed herein is an applicator system. The system comprises a container and an applicator. The container can be configured to contain a substance (e.g. a cream, ointment or lotion such as a cosmetic, therapeutic or medicament cream, ointment or lotion). The substance can be applied using the applicator. The container can be further configured to support the applicator in an accessible orientation in use.

The applicator can be presented for ease of access by a user, and can be used to apply the substance instead of relying on e.g. hand application. This can prevent contamination of the substance, as well as coating of a user's hand.

The container can comprise a first chamber that is open at an end thereof (e.g. at an in-use upper end). The first chamber can receive and locate at least an active end of the applicator therein. The first chamber can also hold the applicator in the accessible orientation in use. The active end of the applicator can be used, for example, to access and apply the substance (e.g. cream, ointment or lotion) held in the container. The active end can be retained in the first chamber before or after use, out of the way of further contamination or handling. The active end may also be washed, wiped, wrapped and/or disinfected before being replaced in the first chamber, and/or before being reused.

The container can also comprise a second chamber that is arranged to receive and hold therein the substance (e.g. a cosmetic, therapeutic, medicament, etc cream, ointment or lotion). In use, the substance may be contacted only by the active end of the applicator.

The container can further comprise a lid. The lid can be configured to close the second chamber to enclose the substance therein in use. The lid can be further configured such that, when it closes the second chamber, it does not close the open end of the first chamber (or at least it does not close the open end such as to hinder the insertion and removal of the applicator). Thus, the applicator is able to remain in the accessible orientation.

In one embodiment, the applicator may be configured to be elongate. For example, the applicator may be configured to have an elongate brush- or pencil-like form.

In one embodiment, the first chamber may be configured such that an opposite (e.g. handle) end of the applicator can project therefrom in the accessible orientation in use. For example, the applicator may be configured to have a length such that e.g. a graspable portion of the applicator protrudes from and beyond the first chamber open end, such as when the active end is located at a base of the first chamber.

In one embodiment, the first chamber and the applicator may each have a configuration such that the applicator can stand within the first chamber (e.g. in a generally upright configuration). This can help facilitate access and grasping of the handle end of the applicator.

In one embodiment, the active end of the applicator may be configured for contacting, retaining and applying the substance held in the container. For example, the applicator active end may comprise a pad, brush or a flexible (e.g. elastomeric) paddle-like head.

In one embodiment, the first chamber may be adjacent to the second chamber.

In one embodiment, the first chamber may be surrounded by the second chamber. In another embodiment, the first chamber may define a segment located within and adjacent to a wall of the container.

In either case, an inner wall of the second chamber may define all or part of an outer wall of the first chamber (e.g. the first and second chambers may share a common wall).

In one embodiment, the second chamber may define a volumetric annulus around the first chamber. In this case, the first chamber may be defined as tubular. The volume of the annulus can hold the substance. The tubular configuration of the first chamber may be optimised towards receiving and supporting the applicator therein (e.g. having a length and effective diameter to support a sufficient portion of the applicator, including supporting the active end at a base of the first chamber). In this regard, an elongate applicator may stand within the tube of the first chamber in a generally upright configuration.

In one embodiment, the lid may be hinge-connected to an external wall of the container. This can enable the lid to pivot between closed and open positions. For example, when the lid is open, the substance in the second chamber may be accessed by the applicator active end.

In one embodiment, the lid may be held closed by a catch. The catch may be located at an in-use upper end of the container. Further, the catch may be configured for manual activation to become released from the lid. When the catch is so-released the lid can pivot away from the closed position.

In one embodiment, the catch may retain a depressible push-button therewithin. This push-button can, for example, allow the catch to be released from the lid free from contamination (e.g. it can be engaged by a non-contaminated or non-coated finger or by handle end of the applicator). The depression of the push-button can cause a latch of the catch to be released from the lid, whereby the lid is able to pivot away from the closed position.

In one embodiment, the lid may be spring-loaded. Thus, once the catch is released from the lid, the spring can cause the lid to pivot to the open position. In other words, this can enhance lid release in a manner that further reduces the likelihood of contamination.

In one embodiment, the catch may be formed as part of a component that is arranged to be mounted at (e.g. to form a part of) the upper end of the container. This means that the catch can be formed separately to the rest of the container. This in turn can mean that the rest of the container can have a volume for the substance that is free from intrusion or interference by the catch. In other words, the substance volume in the container can be maximised.

In one embodiment, the component for the container upper end may comprise a first ring formation (i.e. that can be formed, such as by moulding, separately to the rest of the container). The catch may extend inwardly of the first ring formation and can overlie the second chamber when the first ring formation is mounted to the container upper end. In this way, the catch does not intrude or interfere with the volume of substance able to be held in the second chamber of the container.

The first ring formation may be affixed (e.g. by being screw-mounted, bayonet-fitted, adhesively secured, etc) to the container upper end. In this regard, the first ring formation may have an internally formed thread that is arranged to screw-mount with an externally formed thread arranged at the container upper end.

In one embodiment, the component may further comprise a second ring formation. The second ring formation may locate at and surround the open upper end of the first chamber (i.e. when the first ring formation is affixed to the container upper end). The catch may extend between the first ring formation and the second ring formation. The catch may join the first ring formation to the second ring formation. As will be explained in further detail hereafter, the second ring formation can provide an additional support function to the catch. This, in turn, can help to prevent inadvertent opening of the lid (e.g. when the container is partially or fully empty and a force is applied to the container).

In one embodiment, the catch may comprise a catch formation (i.e. for retention of the componentry of the catch). The catch formation may be integrally formed with the first ring formation to extend inwardly thereof and so that it overlies the second chamber in use. The catch formation may be integrally formed with the second ring formation to extend outwardly thereof, again so that it overlies the second chamber in use. The componentry of the catch, namely, the depressible push-button and latch, can be retained within the catch formation in use.

In one embodiment, the component for the container upper end (e.g. at the first ring formation) may further comprise an external mounting for the hinge of the lid. This external mounting may comprise e.g. two ringlets that are e.g. integrally moulded with the component (e.g. integrally moulded with the first ring formation). The external mounting may receive an axle of the hinge in use. In this way, the hinge can be separated from the rest of the container.

Also disclosed herein is a container for use with the system as set forth above. The container comprises a first chamber that is open at an end thereof (e.g. open at an in-use upper end). The first chamber is arranged to receive and locate at least an active end of an applicator therein and to hold the applicator in an accessible orientation in use. The container also comprises a second chamber that is arranged to receive and hold therein a substance to be contacted by the active end of the applicator in use. The container further comprises a lid. The lid can close the second chamber to enclose the substance therein in use. The lid may be further configured such that, when it closes the second chamber, it does not close the open end of the first chamber (or at least it does not close the open end such as to hinder the insertion and removal of the applicator). Thus, the applicator is able to remain in the accessible orientation.

The container can be configured such that the second chamber may completely surround the first chamber. As set forth above, this means that the second chamber can have a volume for the substance that is free from intrusion or interference (e.g. such as by the catch, etc). In other words, the volume of substance in the second chamber can be maximised. Further, as set forth above, other components of the container (e.g. the catch, latch, lid, etc) do not intrude or interfere with the volume of substance able to be held in the second chamber. The configuration also simplifies manufacture of the container (i.e. simpler mould, less moving parts), as well as filling of the container, and accessing of the substance in use.

The container may be otherwise configured as set forth above for the system.

BRIEF DESCRIPTION OF THE DRAWINGS

Embodiments of a system comprising a container and an applicator, as set forth in the Summary, will now be described, by way of example only, with reference to the accompanying drawings in which.

DETAILED DESCRIPTION

Referring firstly to FIGS. 1 to 6, a first embodiment of an applicator system is shown that comprises a container in the form of a modified tub-like container, hereafter a "tub" 10, and an applicator in the form of an ergonomically shaped and sized elongate brush 12 for use with the tub 10.

Figures 6A, 6B:
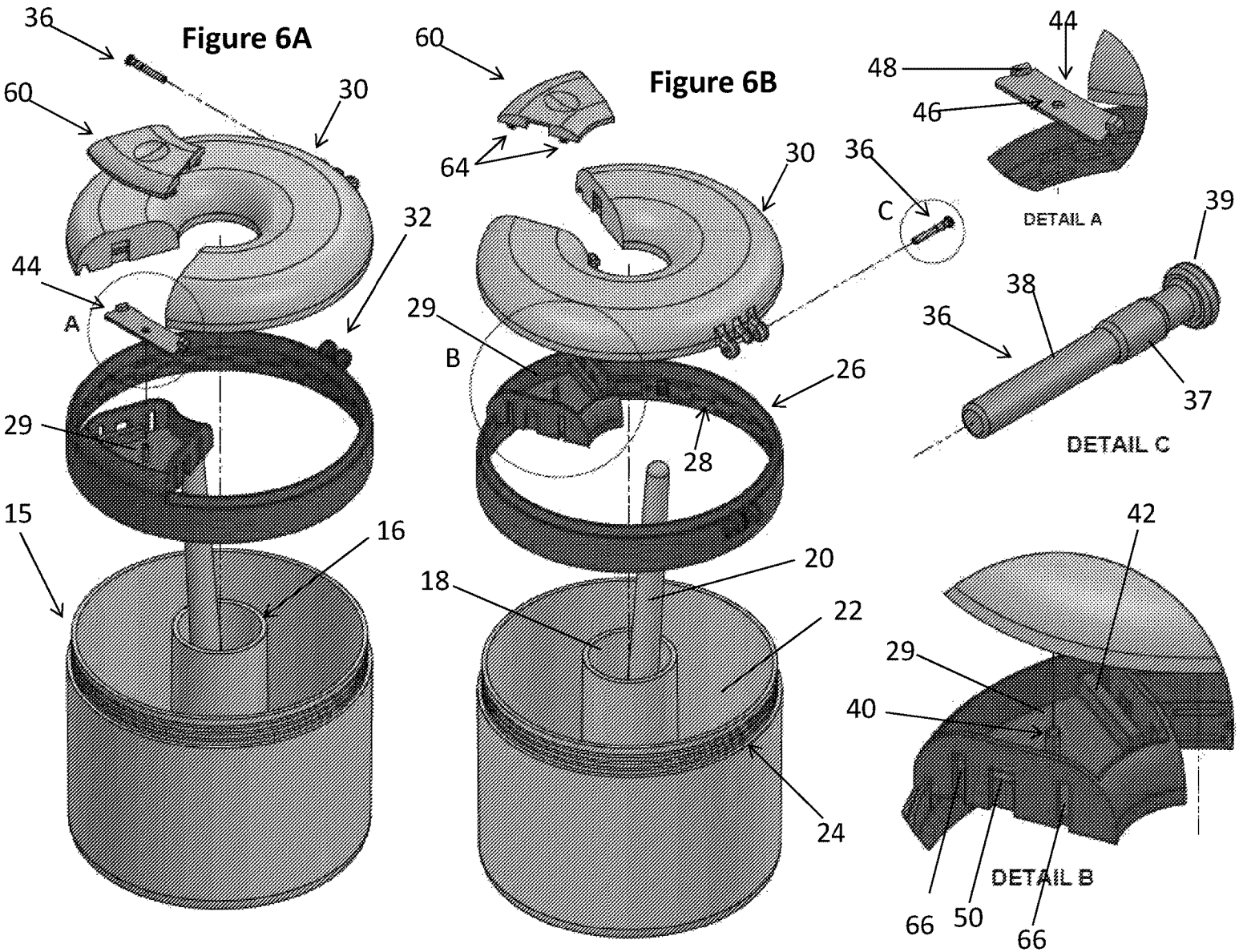
FIGS. 6A and 6B respectively show front and rear exploded perspective views of the first embodiment of the container and applicator, with detail A illustrating a latch of the catch, with detail B illustrating a mounting support of the catch, and with detail C illustrating a hinge pin of the lid hinge.

The system enables the brush 12 to be supported in an accessible orientation in use, and can also prevent inadvertent user contact with a substance held in the tub 10. The system can further prevent inadvertent contamination of the brush 12. In addition, and as best shown in FIGS. 6A & B, the configuration of the components of the tub 10 is such as to maximise the annular volume for the substance to be held in the tub 10. This is explained in further detail below.

An active end 14 of the brush 12 is formed to be able to access, contact and subsequently apply a substance that is held in the tub 10 (e.g. a cosmetic, therapeutic or medicament cream, ointment or lotion). The active brush end 14 can comprise a porous or pad-like polymeric foam material, a brush such as of synthetic or natural hair/fibre, or a flexible (e.g. polymeric or elastomeric) paddle-like head.

The components of the tub 10 are typically injection moulded from a plastic material. The same or different plastic can be used for each component. The plastic can, for example, comprise a gas-assisted polypropylene which is able to be injected into moulds so as to properly define, in and throughout the mould, wall thicknesses that vary throughout the components of the tub. Also, use of such a plastic can produce a high quality finish.

As best shown in FIGS. 6A & B, the tub 10 comprises a base portion 15 which is configured for holding the substance as well as the brush 12. In this regard, the base portion 15 comprises a first chamber in the form of a central tubular recess 16. The recess 16 is open at an upper end 18 thereof and is closed at its base. As best shown in e.g. FIGS. 4B, 6A & B, the recess 16 can receive and locate therein the active brush end 14 of the brush 12, as well as a portion of an elongate handle 20 of the brush 12. As best shown in e.g. FIGS. 1 and 4A, the length of handle 20 is such that a significant portion thereof is able to protrude from and beyond the open end 18 of the recess 16 when the active brush end 14 is located at the base of the recess 16. This orientation promotes easy access and handling of the brush 12 in use.

The active brush end 14 is retained in the recess 16 before and after use, out of the way of contamination and handling. The active brush end 14 can be washed, wiped, wrapped and/or disinfected before being replaced in the recess 16, and/or before being reused. A base of the tubular recess 16 may optionally hold a disinfectant. The recess 16 may also comprise a projecting flange, grip or clip that engages part of the brush (e.g. clips onto handle 20) to keep it spaced just above the base of recess 16.

The brush 12 is selected and designed to have a configuration, namely, a sufficient length and width, such that it is able to stand generally upright within the recess 16. In this regard, the tubular configuration of the recess 16 is optimised towards receiving and supporting therein a good/sufficient portion of the handle 20 of brush 12, but also so that a sufficient length of the handle 20 protrudes beyond the recess 16 for ease of accessing/grasping by a user.

The base portion 15 also comprises a second chamber in the form of an annular-shaped volume 22 that is arranged to receive and hold therein the substance. As best shown in FIGS. 6A & B, the annular volume 22 is located adjacent to, and so as to completely surround to thereby define, the tubular profile of recess 16 (i.e. the annular volume 22 defines a volumetric annulus around the recess 16). Thus, the wall of recess 16 provides an inside wall to the annular volume 22 (i.e. a common wall), thereby providing for maximum compactness and use of space in base portion 15.

This also means that the annular volume 22 has a volume for the substance that is free from intrusion or interference (e.g. such as by a lid, lid catch, lid hinge, etc). In other words, the volume of substance to be located in the annular volume 22 can be maximised. The resultant configuration of the base portion 15 is such as to simplify manufacture of this part of the tub 10 (i.e. a simpler mould, with less moving parts). In addition, the base portion 15 can be easily filled with a substance, prior to securing the lid, etc thereto. Also, the use of whole annular volume 22 can improve access to the substance in use, with the brush active end 145 able to be manoeuvred into all parts of the annular volume 22.

It will also be seen in FIGS. 6A & B that an outside upper end of the base portion 15 comprises an externally formed thread 24, for releasably attaching a lid mounting formation, as will now be described.

In this regard, the tub 10 further comprises a lid mounting formation in the form of a detachable mounting ring 26. The mounting ring 26 comprises all of the formations required for securing a lid to the base portion 15, as described hereafter. In other words, base portion 15 can have as simple a configuration as possible. An inside lower portion of the mounting ring 26 is internally threaded 28, with thread 28 corresponding to thread 24, to enable the mounting ring 26 to be releasably screw mounted onto the base portion 15. The mounting ring 26 also comprises an integrally moulded catch formation 29 that projects inwardly of the ring, and which is described hereafter.

Figures 5A, 5B:
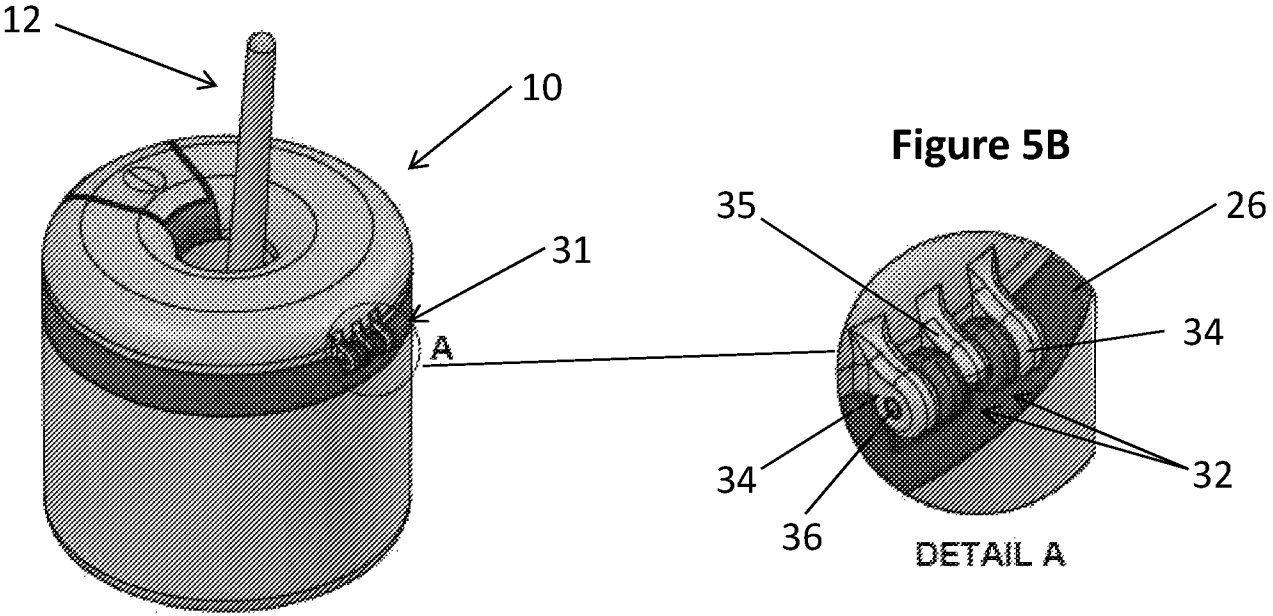
FIGS. 5A and 5B respectively show rear perspective and detail views of the first embodiment of the container and applicator, again with the container in a lid closed configuration, and illustrating a rear hinge configuration of the lid.

A lid 30 of the tub 10 is able to be hingeably attached to the mounting ring 26 at a hinge assembly 31. In this regard, and as best shown in FIG. 5B, the mounting ring 26 comprises two, spaced and integrally moulded loop formations 32 that act as a hinge support for the lid 30. A rear of the lid 30 comprises two corresponding, spaced and integrally moulded loop formations 34 that are configured to locate outside the loop formations 32. The rear of the lid 30 also has a middle projection 35 that is arranged to locate between the loop formations 32 as shown. Apertures through the loops 32, 34 are aligned to provide a passage for a hinge pin 36 to be inserted therethrough (see also FIGS. 6B & detail C).

As shown in the detail of FIG. 6C, the hinge pin 36 comprises an enlargement 37 on its shank 38, the enlargement 37 being spaced along the shank from a head 39 of the pin. During insertion of the pin 36, the enlargement 37 passes interferingly through (i.e. so as to deform) one of the loop formations 34, and so as to then retain that loop formation 34 on the shank 38 (i.e. between the enlargement 37 and the pin head 39). This secures the pin in the hinge. A double-acting helical spring (not shown) is, during pin insertion, arranged on the shank 38, to locate under the middle projection 35 and between the loop formations 32. The spring is arranged and configured to bias the lid 30 into the open position as shown in FIGS. 2A & B.

As set forth above, the mounting ring 26 also comprises an integrally moulded catch formation 29 that projects inwardly of the ring. When the ring 26 has been screw-mounted onto the base portion 15, the catch formation 29 overlies, so as to close a portion of, the annular volume 22

Figure 1B:
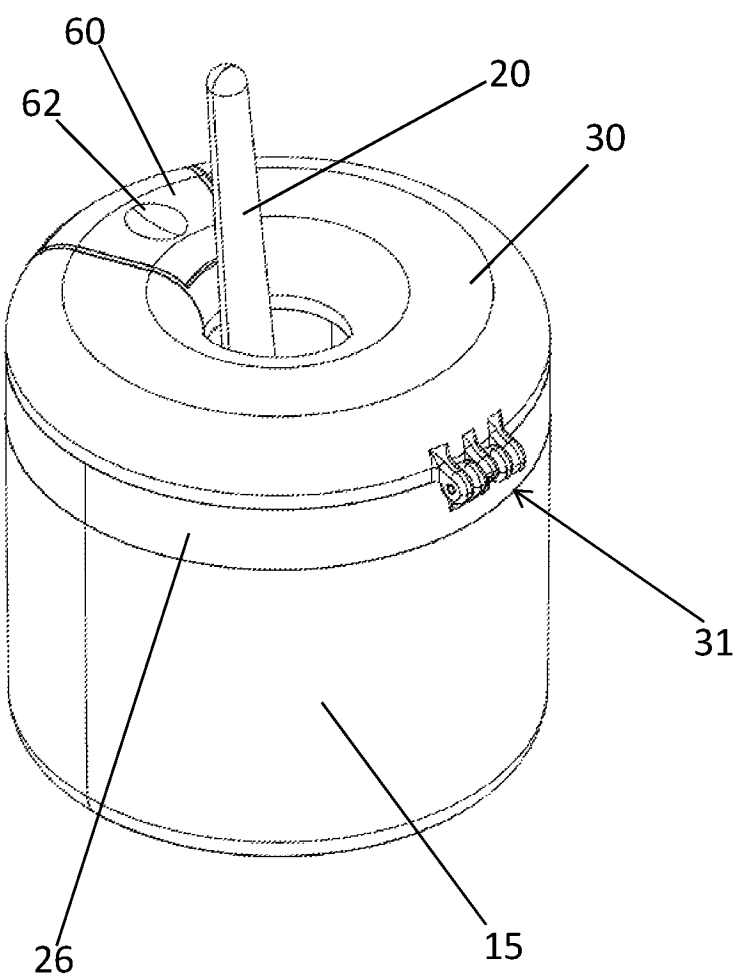
FIGS. 1A and 1B respectively show front and rear perspective views of a first embodiment of a container and applicator of the system, with the container in a (lid) closed configuration.
Figure 1A:
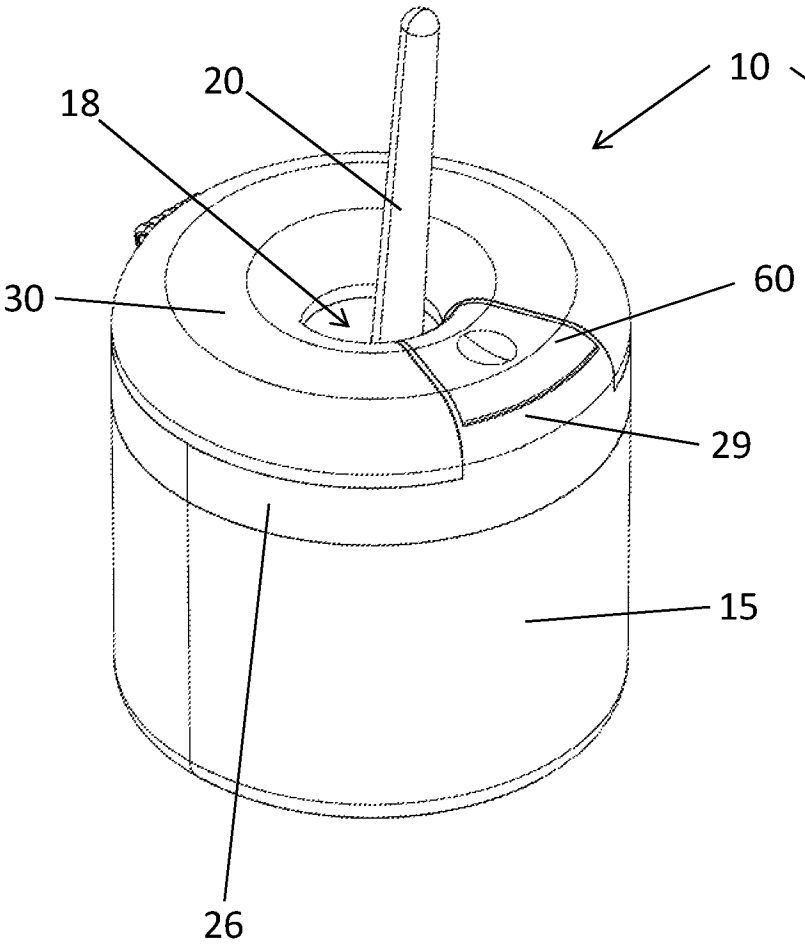
Figures 2A, 2B:
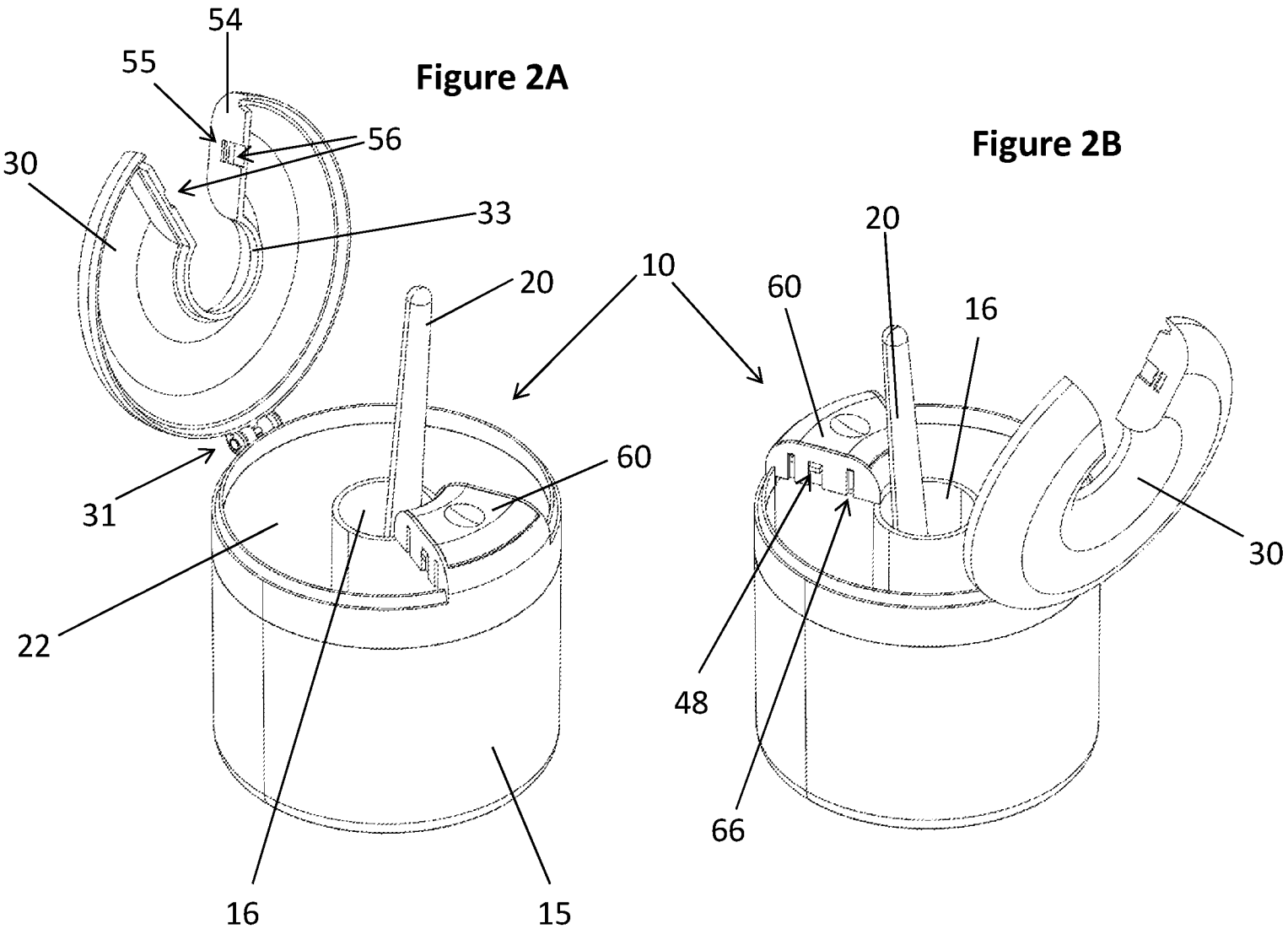
FIGS. 2A and 2B respectively show front and rear perspective views of the first embodiment of the container and applicator, with the container in a (lid) open configuration.

(see e.g. FIG. 2B). In addition, an inner edge of the catch formation 29 can rest on the upper end of the wall of tubular recess 16. As best shown in FIGS. 1A & B, the lid 30 is further configured to close a remainder of the annular volume 22 (i.e. the remaining portion not covered by the catch formation 29). In this regard, an inner rim 33 of the lid can rest on a remainder of the upper end of the wall of tubular recess 16. Further, the lid outer rim rests on the outer wall of the base portion 15 to enclose the substance within the annular volume 22 of tub 10.

Figures 3A, 3B, 3C:
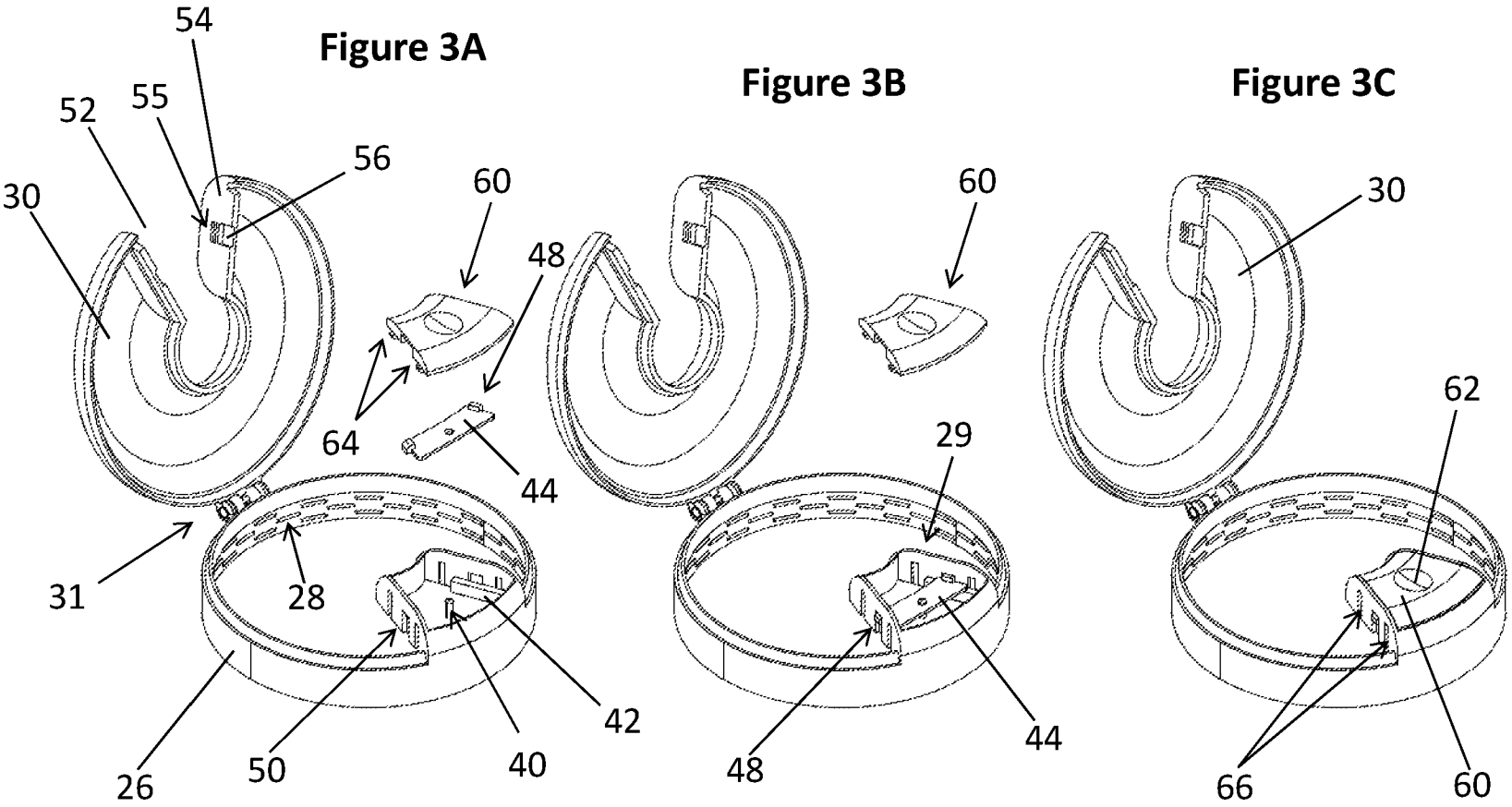
FIGS. 3A to 3C respectively show perspective views of a first embodiment of a lid, catch and mounting formation for the container of FIGS. 1 and 2, with the catch in an exploded configuration in FIG. 3A, with the catch comprising a latch located therein in FIG. 3B, and with the catch being assembled in FIG. 3C.
Figure 4B:
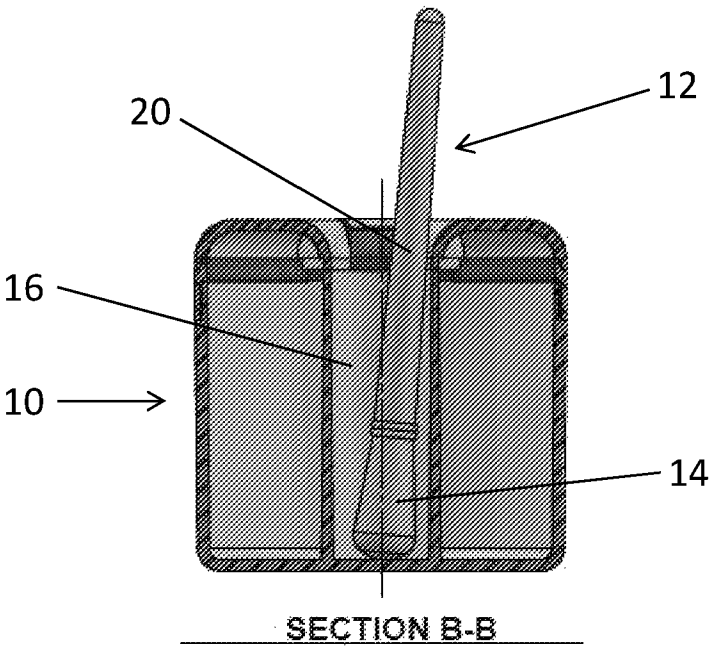
FIGS. 4A and 4B respectively show side and side-sectional views of the first embodiment of the container and applicator, again with the container in a lid closed configuration.
Figure 4A:
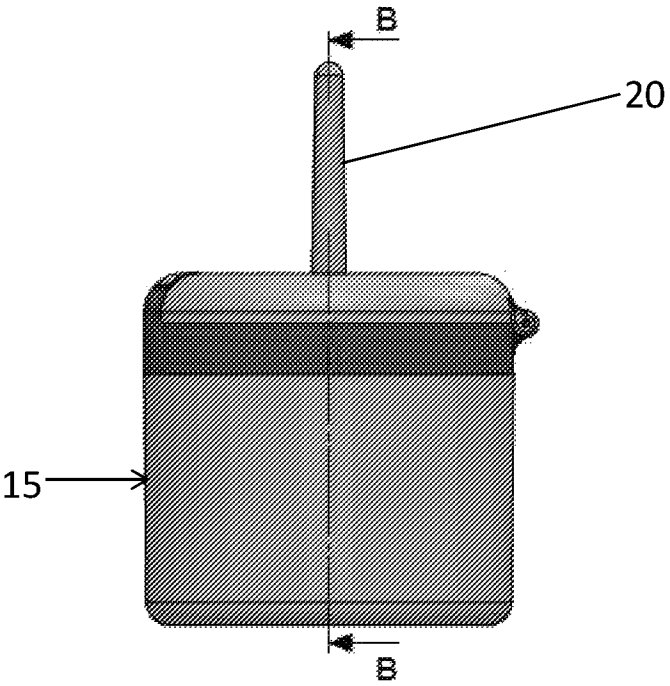

The catch formation 29 is formed to comprise a centrally and integrally formed spigot 40 that projects upwardly from a base of the formation (see FIG. 3A and detail B in FIG. 6). In addition, two spaced, opposite seats 42 are arranged at opposing sides of and within the catch formation 29 to project upwardly therefrom. The spigot 40, together with the seats 42, cooperates to retain and support thereat a deflectable latch plate 44 (typically of a deflectable wear and fatigue resistant metal). As shown in FIGS. 3A & B and detail A of FIG. 6, the latch plate 44 has a central aperture 46 which interferingly receives the spigot 40 therein. Opposite ends of the latch plate 44 then sit on, to traverse over and be supported by, the seats 42. Opposite ends of the latch plate 44 also comprise latching lugs 48. When the latch plate 44 is secured in the catch formation 29, each lug 48 is arranged to protrude from a respective aperture 50 in a respective side wall of the catch formation 29 (see FIG. 3C and detail B in FIG. 6).

Each protruding lug 48 is now able to latchingly engage with the lid 30. In this regard, to enable latching engagement to occur, the lid 30 is provided with a cut-away section 52 that corresponds in shape to the catch formation 29. The cut-away section 52 is configured to snugly receive therein the catch formation 29 when the lid 30 is closed.

It should be noted that the lid 30 is further configured such that, when the lid 30 acting together with the catch formation 29 closes the annular volume 22, it does not close the open end 18 of the recess 16, at least so as not to hinder brush access (i.e. so as not to hinder insertion and removal of the brush 12 (see e.g. FIGS. 1A & B).

Each side wall 54 of the cut-away section 52 has corresponding slot 55 formed therein, with the slot arranged to latchingly receive a respective latching lug 48 therein (i.e. when the lid is closed, as in FIGS. 1A & B). Each slot 55 is defined above a rebate 56 that is centrally located in its respective side wall 54 (see e.g. FIGS. 3A to C).

The catch formation 29 further retains a depressible push-button 60 thereat. The push-button 60 has a depression 62 into which a user's finger is received in use. The opposite side walls of the push-button 60 each comprise spaced apart, laterally projecting guide lugs 64 moulded therewith (see FIGS. 3A & 6B). When the push-button 60 is press-located into the catch formation 29, each guide lug 64 is urged so as to locate in a respective vertical passage 66 (see FIG. 3C and detail B in FIG. 6), with each passage defined in a respective and close-facing side wall of the catch formation 29. Once so located, the push-button 60 sits on and is supported by the deflectable latch plate 44.

In use, when the push-button 60 is depressed, the guide lugs 64 each track downwardly in their respective passage 66, and a central portion of the latch plate 44 is also caused to be deflected downwardly. However, the ends of the latch plate 44 do not deflect down, as they rest on their respective seats 42. In fact, these ends are deflected slightly up. This in turn causes each latching lug 48 to be withdrawn into its respective aperture 50 and out of latching engagement with its corresponding slot 55 of the lid 30. This now releases the lid 30, so that it can be pivoted up and away by the action of its spring-loaded hinge. The tub 10 is now open (FIGS. 2A & B), and the substance held therein can be accessed.

After use, when the lid is manually closed by a user, the rebates 56 in the side walls 54 of the lid 30 enable the lid to be moved past the latching lugs 48, until these lugs deflect and are aligned to re-latch with their corresponding slots 55.

Figure 7B:
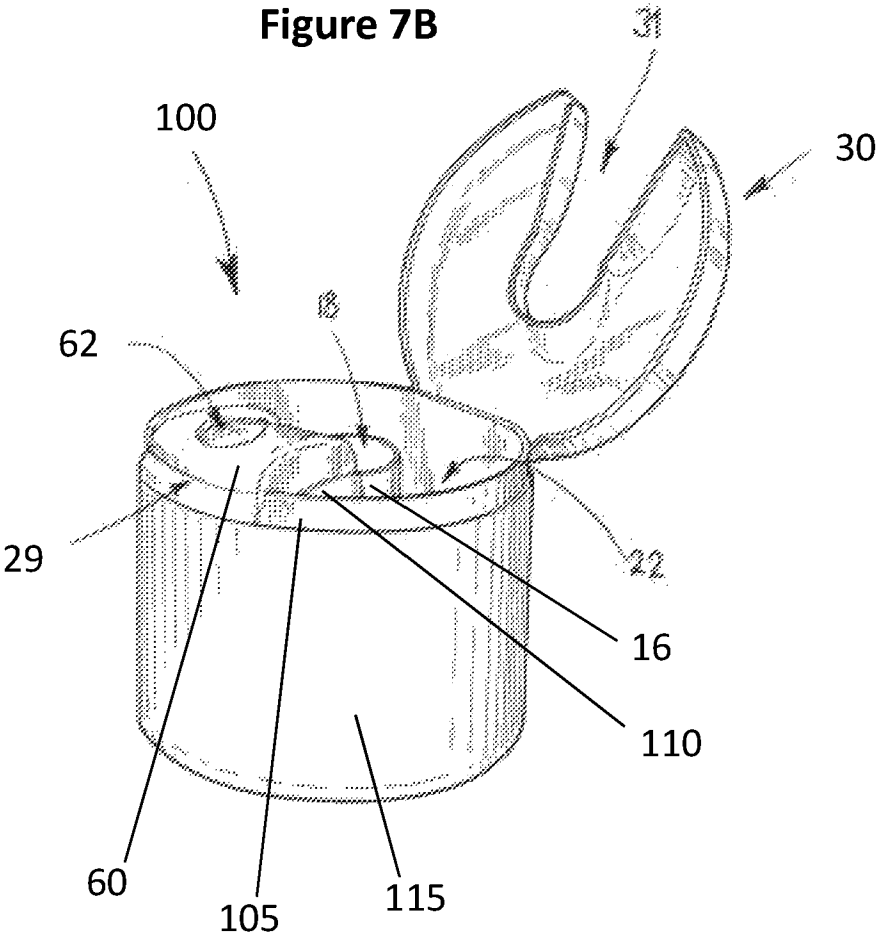
FIGS. 7A and 7B respectively show perspective views of a second embodiment of a container, with the container in (lid) closed and (lid) open configurations respectively.
Figure 7A:
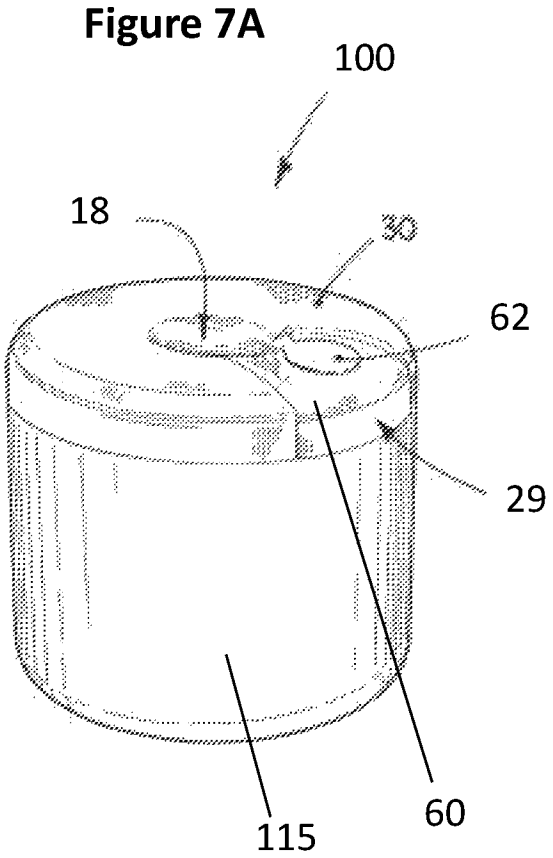

Referring now to FIGS. 7A & B, where like reference numerals are used to denote similar or like parts, a second embodiment of an applicator system is shown that comprises a container in the form of another modified tub-like container, hereafter tub 100. In FIGS. 7A & B, the applicator in the form of the brush 12 is removed for clarity.

The tub 100 is in many respects the same as the tub 10. However, in tub 100 the base portion 15 is modified to take the form of an integral tub base 115. In tub base 115 the tubular recess 16 does not stand solely upright from the base. Rather, the tubular recess 16 is connected to a remainder of the tub base 115 via supporting walls 110. This means that the annular volume 22 does not extend completely around the tubular recess 16, with the annular volume 22 being truncated by the supporting walls 110. Thus, the available volume for the substance is reduced.

In addition, tub 100 does not employ a separate mounting ring 26. Rather, the upper rim of the tub base 115 is defined by a rebated circumferential region 105. The lid 30 closes around and into this rebated region 105, as illustrated in FIG. 7A. Furthermore, the catch formation 29 is integrally mounted with the rebated region 105. Thus, the push-button 60 extends over and locates between the supporting walls 110.

The operation and function of the tub 100 is, in most other respects, the same as that described above for the tub 10.

Figure 8B:
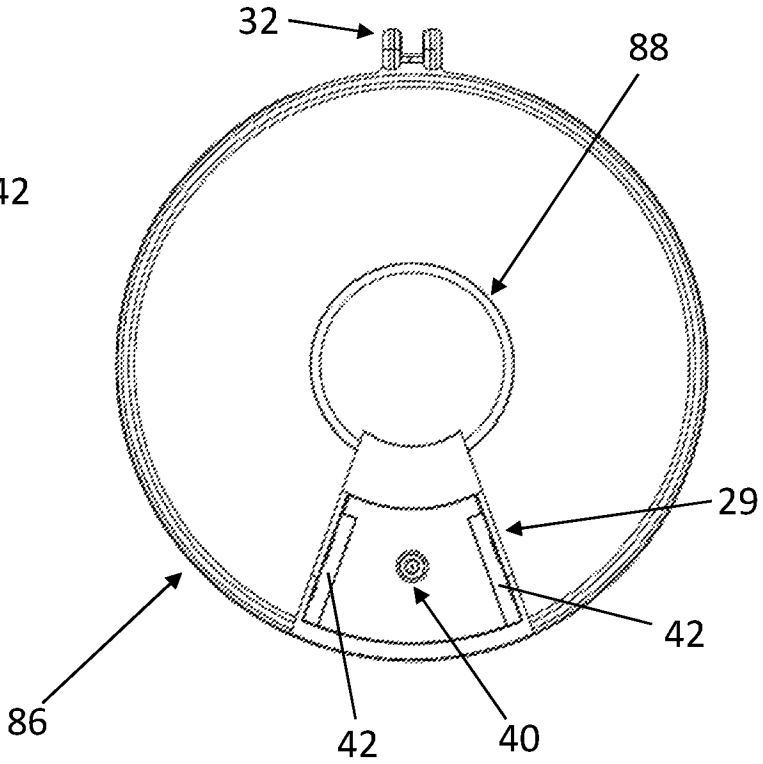
FIGS. 8A and 8B respectively show perspective and plan views of a second embodiment of a catch and mounting formation for a container, with FIGS. 8C and 8D showing the catch and mounting formation of FIGS. 8A and 8B, along with an associated lid, in place on a container that is like that shown in FIGS. 6A & 6B.
Figure 8A:
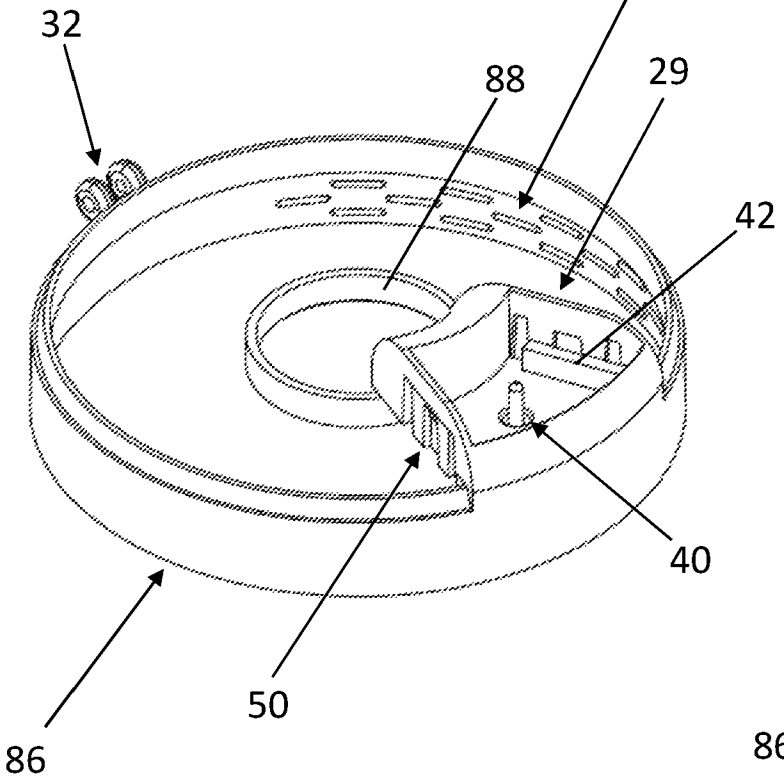
Figure 8D:
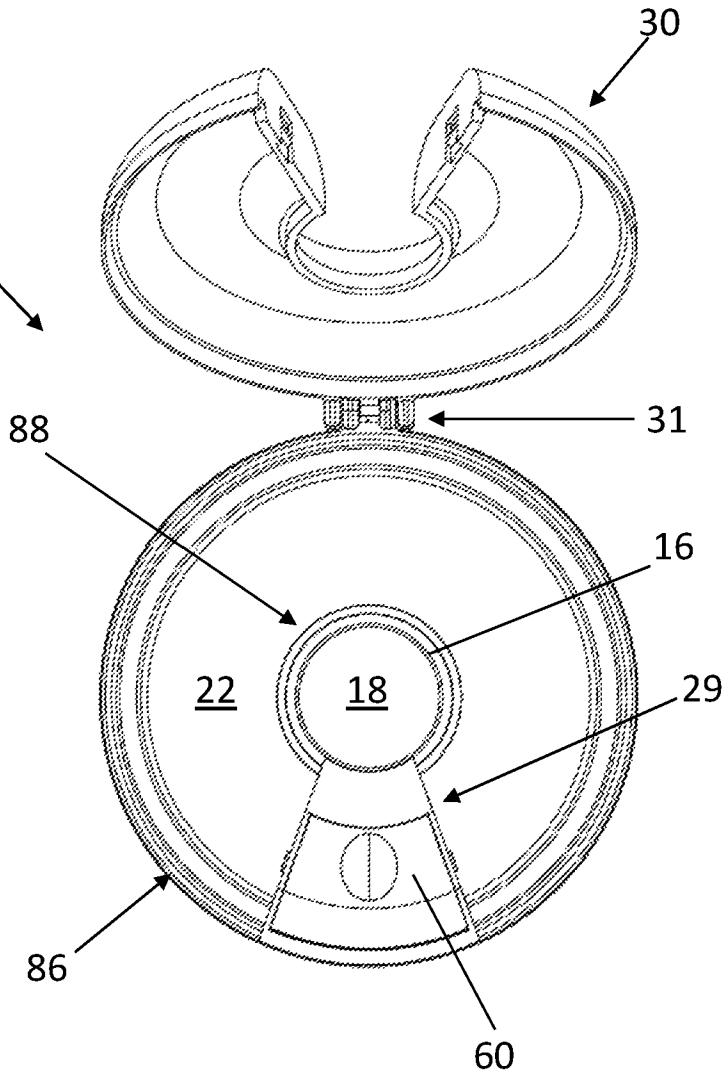
Figure 8C:
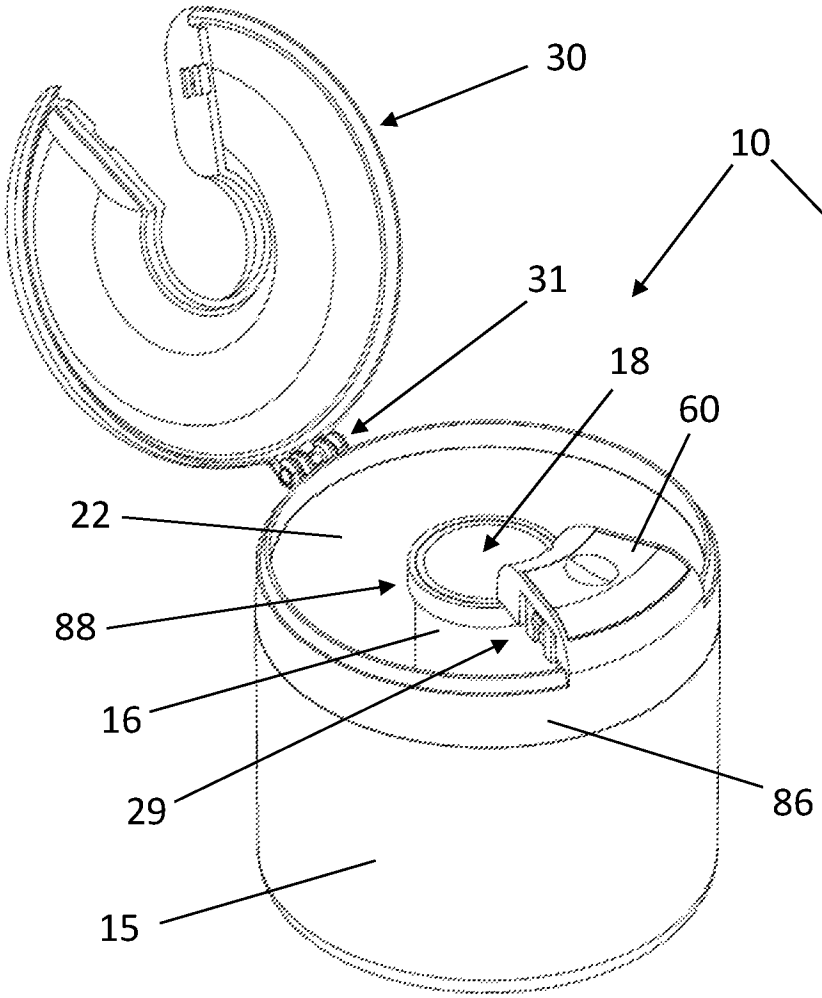

Referring now to FIGS. 8A to 8D, where like reference numerals are used to denote similar or like parts, a second embodiment of a catch and mounting formation in the form of a modified mounting ring 86 is depicted. FIGS. 8C and 8D show the modified mounting ring 86 of FIGS. 8A and 8B, along with an associated lid 30, when in place on a base portion 15 that is much like that shown in FIGS. 6A & 6B.

In FIGS. 8A and 8B, the modified, detachable mounting ring 86 that is shown is very much like the detachable mounting ring 26 as shown in FIGS. 3A to 3C. Hence, like reference numerals will be used to denote similar or like parts to those shown in FIGS. 3A to 3C, with these parts not being re-described in detail.

In this regard, the modified mounting ring 86 again comprises each of the formations required to secure the lid 30 to the base portion 15 of the tub 10. Again, this means that the base portion 15 can have as simple a configuration as possible. In this regard, an inside lower portion of the mounting ring 86 is internally threaded 28 to enable the mounting ring 86 to be releasably screw-mounted onto the base portion 15. The mounting ring 86 also comprises an integrally moulded catch formation 29 that projects inwardly of the ring 86.

However, in accordance with the modification to the mounting ring 86, the mounting ring further comprises a second ring formation in the form of a support ring 88. As best shown in FIGS. 8A & 8B, the support ring 88 is connected to the underside of an inward distal end of the catch formation 29 (e.g. it can be integrally moulded with the catch formation 29). As shown in FIGS. 8C & 8D, the support ring 88 is able locate at and surround the open upper end 18 of the tubular recess 16 (i.e. once the mounting ring 86 has been affixed (i.e. screwed on) to the base portion 15 of the tub 10). For example, the support ring 88 can configured (e.g. sized) so as to be press- or push-mounted (e.g. in a force- or interference-type fit) onto the upper end 18 of the tubular recess 16. Additionally, an adhesive may be employed to affix the support ring 88 to the upper end 18 of tubular recess 16.

Thus, the catch formation 29 extends between the mounting ring 86 and the support ring 88. Once the mounting ring 86 has been mounted to the base portion 15, the catch formation 29 is able to thereby form a "bridge" between the tubular recess 16 and the base portion 15. This bridge can provide additional support to the catch formation 29, and thereby provide additional support to the componentry of the catch (i.e. to the spigot 40, seats 42, latch plate 44 and push-button 60). This additional support function can, in turn, help to prevent inadvertent opening of the lid 30, such as which might otherwise occur when the base portion 15 of the tub 10 is partially or fully empty and a force (e.g. bump, blow, squeeze, etc.) is applied to a side wall of the base portion 15.

In each of the tub 10 and tub 100, the push-button 60 can be depressed by a user's finger or by a remote end of the brush handle 20 (i.e. the latter typically being free from contamination or substance). Further, because the hinge spring causes the lid 30 to pivot to the open position, a user does not need to remove the lid manually, using fingers or hands that can be contaminated or coated with substance, thus further reducing the likelihood of contamination.

When the lid 30 is open, the user can still easily access and handle the brush 12. The active brush end 14 can be dipped into the substance, and then applied by the user (e.g. applied to another person, such as a baby, child, elderly person, etc, or to themselves). Thereafter, the active brush end 14 can be repositioned in the recess 16, out of the way of contamination. The active brush end 14 can be washed, wiped, wrapped and/or disinfected before being replaced in the recess 16, and/or before being reused.

Now that a number of embodiments have been described, it will be appreciated that numerous variations and/or modifications may be made to the disclosed embodiments.

For example, the tub 10, 100 may be reshaped, whereby the recess 16 is defined as a segment located adjacent to a wall of the tub. The lid 30 can be reshaped accordingly. The tub may be square, rectangular, etc. The lid 30 may be mounted and pivoted without spring activation.

In another example, the catch formation 29 and/or mounting ring 26 can be co- or bi-moulded together with the tub, instead of being formed as separate parts to be fitted during assembly.

The present embodiments are, therefore, to be considered in all respects as illustrative and not restrictive.

In the claims which follow and in the preceding description of the applicator system, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the applicator system.

The invention claimed is:

1. An applicator system comprising a container and an applicator, the container being configured to contain a substance to be applied using the applicator, the container being further configured to support the applicator in an accessible orientation in use, wherein the container comprises:

a first chamber that is open at an in-use upper end thereof, the first chamber arranged to receive and locate at least an active end of the applicator therein and to hold the applicator in the accessible orientation in use;

a second chamber that is open at an in-use upper end thereof, the second chamber arranged to receive and hold therein the substance to be contacted by the active end of the applicator in use;

a lid that is configured to close the open upper end of the second chamber to enclose the substance therein in use, the lid being further configured such that, when it closes the open upper end of the second chamber, it does not close the open upper end of the first chamber, whereby the applicator is able to remain in the accessible orientation; and a catch located at an in-use upper end of the container and extended between a wall of the first chamber and a wall of the second chamber to cover a portion of the open upper end of the second chamber, the lid able to be held closed by the catch to cover a remaining portion of open upper end of the second chamber, the catch configured for manual activation to become released from the lid, whereby the lid is released from a closed position and from the catch.

2. A system as claimed in claim 1, wherein the applicator is elongate, and wherein the first chamber and the applicator each have a configuration such that an opposite end of the applicator is able to protrude from and beyond the first chamber open end when the active end is located at a base of the first chamber.

3. A system as claimed in claim 1, wherein the first chamber and the applicator each have a configuration such that the applicator is generally able to stand within the first chamber.

4. A system as claimed in claim 1, wherein the active end of the applicator is configured for contacting, retaining and applying the substance held in the container.

5. A system as claimed in claim 1, wherein the first chamber is one or both of:

adjacent to the second chamber;

surrounded by the second chamber.

6. A system as claimed in claim 1, wherein the second chamber defines a volumetric annulus around the first chamber, whereby the first chamber is defined as tubular.

7. A system as claimed in claim 1, wherein the lid is hinge-connected to an external wall of the container, and is able to pivot between closed and open positions.

8. A system as claimed in claim 1, wherein the catch is configured to retain a depressible push-button therewithin, the depression of which causes a latch of the catch to be released from the lid, whereby the lid is able to pivot away from the closed position.

9. A system as claimed in claim 1, wherein the lid is spring-loaded whereby, once the catch is released from the lid, the spring causes the lid to pivot to an open position.

10. A system as claimed in claim 1, wherein the catch is formed as part of a component that is arranged to be mounted at the upper end of the container.

11. A system as claimed in claim 10, wherein the component comprises a first ring formation that is able to be affixed to the container upper end, with the catch extending inwardly of the first ring formation and overlying the second chamber.

12. A system as claimed in claim 11, wherein the catch comprises a catch formation that is integrally formed with the first ring formation to extend inwardly thereof to overlie the second chamber in use, with a depressible push-button and latch being retained within the catch formation.

13. A system as claimed in claim 11, wherein the component further comprises a second ring formation that is able to locate at and surround the open upper end of the first chamber when the first ring formation is affixed to the container upper end, with the catch extending between and joining the first ring formation to the second ring formation.

14. A system as claimed in claim 11, wherein the component for the container upper end further comprises an external mounting for a hinge of the lid.

15. A container for use with the system as set forth in claim 1, the container comprising:

a first chamber that is open at an in-use upper end thereof, the first chamber arranged to receive and locate at least an active end of an applicator therein and to hold the applicator in an accessible orientation in use;

a second chamber that is open at an in-use upper end thereof, the second chamber arranged to receive and hold therein a substance to be contacted by the active end of the applicator in use;

a lid that is configured to close the open upper end of the second chamber to enclose the substance therein in use, the lid being further configured such that, when it closes the open upper end of the second chamber, it does not close the open upper end of the first chamber, whereby the applicator is able to remain in the accessible orientation in use; and a catch located at an in-use upper end of the container and extended between a wall of the first chamber and a wall of the second chamber to cover a portion of the open upper end of the second chamber, the lid able to be held closed by the catch to cover a remaining portion of open upper end of the second chamber, the catch configured for manual activation to become released from the lid, whereby the lid is released from a closed position and from the catch.

16. A container as claimed in claim 15 wherein the first chamber is one or both of:

adjacent to the second chamber;

surrounded by the second chamber.

17. A container as claimed in claim 15, wherein the second chamber defines a volumetric annulus around the first chamber, whereby the first chamber is defined as tubular.

18. A container as claimed in claim 15, wherein the lid is hinge-connected to an external wall of the container, and is able to pivot between the closed position and an open position.

19. A container as claimed in claim 15, wherein the catch is configured to retain a depressible push-button therewithin, the depression of which causes a latch of the catch to be released from the lid, whereby the lid is able to pivot away from the closed position.

20. A container as claimed in claim 15, wherein the lid is hinge-connected to an external wall of the container, and is able to pivot between closed and open positions, and wherein the lid is spring-loaded whereby, once the catch is released from the lid, the spring causes the lid to pivot to an open position.

21. An applicator system comprising a container and an applicator, the container being configured to contain a substance to be applied using the applicator, the container being further configured to support the applicator in an accessible orientation in use, wherein the container comprises:

a first chamber that is open at an in-use upper end thereof, the first chamber arranged to receive and locate at least an active end of the applicator therein and to hold the applicator in the accessible orientation in use;

a second chamber that is open at an in-use upper end thereof, the second chamber arranged to receive and hold therein the substance to be contacted by the active end of the applicator in use;

a lid that is configured to close the open upper end of the second chamber to enclose the substance therein in use, the lid being further configured such that, when it closes the open upper end of the second chamber, it does not close the open upper end of the first chamber, whereby the applicator is able to remain in the accessible orientation, and wherein the lid includes an aperture positioned over the first chamber and a cutaway section extending between an outer lateral edge of the lid and the aperture; and a catch located at an in-use upper end of the container to cover a portion of the open upper end of the second chamber, the lid able to be held closed by the catch to cover a remaining portion of open upper end of the second chamber, the catch configured for manual activation to become released from the lid, whereby the lid is released from a closed position and from the catch.

22. A container for use with the system as set forth in claim 21, the container comprising:

a first chamber that is open at an in-use upper end thereof, the first chamber arranged to receive and locate at least an active end of an applicator therein and to hold the applicator in an accessible orientation in use;

a second chamber that is open at an in-use upper end thereof, the second chamber arranged to receive and hold therein a substance to be contacted by the active end of the applicator in use;

a lid that is configured to close the open upper end of the second chamber to enclose the substance therein in use, the lid being further configured such that, when it closes the open upper end of the second chamber, it does not close the open upper end of the first chamber, whereby the applicator is able to remain in the accessible orientation in use, wherein the lid includes an aperture positioned over the first chamber and a cutaway section extending between an outer lateral edge of the lid and the aperture; and a catch located at an in-use upper end of the container to cover a portion of the open upper end of the second chamber, the lid able to be held closed by the catch to cover a remaining portion of open upper end of the second chamber, the catch configured for manual activation to become released from the lid, whereby the lid is released from a closed position and from the catch.

* * * * *